US009228158B2

(12) United States Patent
Tinker et al.

(10) Patent No.: US 9,228,158 B2
(45) Date of Patent: Jan. 5, 2016

(54) COMPOSITION AND METHOD FOR REMOVING STAINS DERIVED FROM CHLORHEXIDINE GLUCONATE

(71) Applicant: Gurtler Industries, Inc., South Holland, IL (US)

(72) Inventors: Steven J. Tinker, Frankfort, IL (US); Samuel Garofalo, Charlotte, NC (US); Karina Nieto, Chicago, IL (US); Eli Cryderman, Lowell, IN (US)

(73) Assignee: Gurtler Industries, Inc., South Holland, IL (US)

( * ) Notice: Subject to any disclaimer, the term of this patent is extended or adjusted under 35 U.S.C. 154(b) by 334 days.

(21) Appl. No.: 13/757,458

(22) Filed: Feb. 1, 2013

(65) Prior Publication Data

US 2013/0192006 A1 Aug. 1, 2013

Related U.S. Application Data

(60) Provisional application No. 61/593,609, filed on Feb. 1, 2012.

(51) Int. Cl.

| | |
|---|---|
| ***C11D 1/72*** | (2006.01) |
| ***C11D 7/08*** | (2006.01) |
| ***B08B 3/04*** | (2006.01) |
| ***C11D 3/04*** | (2006.01) |
| ***C11D 3/20*** | (2006.01) |
| ***C11D 3/06*** | (2006.01) |

(52) U.S. Cl.

CPC ..... *C11D 3/042* (2013.01); *C11D 3/046* (2013.01); *C11D 3/06* (2013.01); *C11D 3/2075* (2013.01); *C11D 3/2079* (2013.01); *C11D 3/2082* (2013.01); *C11D 3/2086* (2013.01)

(58) Field of Classification Search

CPC ..... C11D 1/72; C11D 3/042; C11D 7/08; B08B 3/04

See application file for complete search history.

(56) References Cited

U.S. PATENT DOCUMENTS

| | | | | |
|---|---|---|---|---|
| 4,220,562 | A | 9/1980 | Spadini et al. | |
| 4,412,934 | A | 11/1983 | Chung et al. | |
| 4,483,781 | A | 11/1984 | Hartman | |
| 4,634,551 | A | 1/1987 | Burns et al. | |
| 4,704,212 | A * | 11/1987 | Schindler et al. | 510/518 |
| 5,616,281 | A | 4/1997 | Hardy et al. | |
| 5,763,412 | A | 6/1998 | Khan et al. | |

(Continued)

FOREIGN PATENT DOCUMENTS

| | | |
|---|---|---|
| EP | 133354 | 2/1985 |
| EP | 0537381 | 4/1993 |

(Continued)

OTHER PUBLICATIONS

U.S. Appl. No. 08/136,626 by Chanchal K. Ghosh, filed Oct. 14, 1993.

(Continued)

*Primary Examiner* — Brian P Mruk

(74) *Attorney, Agent, or Firm* — Michael Best & Friedrich LLP

(57) ABSTRACT

Provided herein is a composition and a method for removing CHG from textiles. The composition is an acid-surfactant-based composition that may be used to remove CHG from a textile that has not been exposed to chlorine subsequent to being exposed to CHG.

14 Claims, 2 Drawing Sheets

(56) References Cited

U.S. PATENT DOCUMENTS

| | | | |
|---|---|---|---|
| 6,077,818 | A | 6/2000 | Baeck et al. |
| 2008/0286215 | A1 | 11/2008 | Attstrom |

FOREIGN PATENT DOCUMENTS

| | | | | |
|---|---|---|---|---|
| EP | 0540784 | | 5/1993 | |
| JP | 11-229271 | | 8/1999 | |
| WO | 89/09813 | | 10/1989 | |
| WO | 94/12621 | | 6/1994 | |
| WO | 94/28106 | | 12/1994 | |
| WO | 95/27772 | | 10/1995 | |
| WO | 95/27773 | | 10/1995 | |
| WO | 95/27774 | | 10/1995 | |
| WO | 95/27775 | | 10/1995 | |
| WO | 97/00937 | | 1/1997 | |
| WO | 2005/035708 | | 4/2005 | |
| WO | WO 2011/077144 | * | 6/2011 | ..... C11D 3/02 |

OTHER PUBLICATIONS

PCT/US2013/024455 International Search Report and Written Opinion dated May 15, 2013 (9 pages).

American Cleaning Institute, "The Low Down on Energy-Efficient Laundering," http://www.cleaninginstitute.org/cleanliving/energyefficient laundering.aspx, available online as early as Dec. 29, 2010.

AATC, "Technical Manual of the American Association of Textile Chemists and Colorists," vol. 85, 2010.

* cited by examiner

COMPOSITION AND METHOD FOR REMOVING STAINS DERIVED FROM CHLORHEXIDINE GLUCONATE

CROSS REFERENCE TO RELATED APPLICATIONS

This application claims the benefit of U.S. Provisional Application No. 61/593,609, filed on Feb. 1, 2012, the entire contents of which are incorporated herein by reference.

FIELD OF THE INVENTION

The present invention relates to a composition and method for removing chlorhexidine gluconate ("CHG")-based stains from textiles.

BACKGROUND

Soiled and/or stained textiles, especially hospital garments, have been a consistent and on-going problem for the laundry cleaning industry. For example, since the advent of various skin cleansers and disinfectants, textiles often come into contact with such compositions whereby permanent staining of the textile may result. In the healthcare textile laundries, the use of topical antiseptic agents on patients is of concern as the adjacent textiles, such as gowns and other clothing and bedding, are routinely exposed and stained by said agents.

Common to the market of skin cleansers and disinfectants are compositions that contain CHG, which tends to bind to protein in the stratum corneum of the skin. CHG is an antimicrobial agent that has bactericidal and bacteriostatic mechanisms of action via the disruption of bacterial membranes. It is used in oral rinses and skin cleansers and marketed under a variety of brand names. Because of its antimicrobial capabilities, CHG is often used in hospital settings as a surgical scrub, as a rubbing agent prior to the use of hypodermic or intravenous needles (in place of iodine), and/or as an agent for pre-operatively preparing skin for a medical procedure.

The protein binding characteristic of CHG results in a persistent residue on the surface of the skin, which can come into contact with textiles meant to cover the skin. As a result, CHG may become adsorbed onto the textile, which cannot be removed by washing and/or the application of chlorine bleach; traditional washing in the presence of one or more alkaline detergents and chlorine bleach will fix the CHG to the textile. When textiles stained with compositions containing CHG, are laundered initially in a traditional alkaline detergent wash, followed by a hydrogen peroxide or other similar oxygen-based bleaching solution, the CHG stain is not visible; however, a colorless residue may remain in the textile. If this CHG-bound textile is then ever exposed to chlorine bleach, a permanent dark stain will appear where the CHG is present. This is due to a chemical reaction between CHG and chlorine.

Therefore, a composition and a process are needed that will remove the CHG from textiles completely, thereby allowing for the textile to be laundered with chlorine-based bleaching systems and, for example, in alkaline conditions. Such a composition and process would not result in a permanent stain.

SUMMARY OF THE INVENTION

Provided herein is a laundry stain removal composition for removing CHG from a textile. The composition may comprise an acid and a surfactant, wherein the composition is capable of preventing permanent stains derived from contact between CHG and chlorine bleach on the textile. The composition may have a pH of less than or equal to 2.0. The acid may be a phosphoric acid, hydrofluorosilicic acid, citric acid, sulfuric acid, hydroxyacetic (glycolic) acid, benzoic acid, oxalic acid, acetic acid, formic acid, malic acid, succinic acid, gluconic acid, hydrochloric acid, boric acid, perchloric acid, nitric acid, nitrous acid, sodium silicofluoride, monosodium phosphate, disodium phosphate, or any mixture thereof. The acid may be 10% to 75% of the composition. The surfactant may be a nonylphenol ethoxylate having 6 to 15 ethylene oxide ("EO") units, linear alcohol ethoxylate ($C_{12}$-$C_{13}$ alcohol with 3 to 12 EO units), linear alcohol ethoxylate ($C_{12}$-$C_{15}$ alcohol with 5 to 12 EO units), cocodiethanolamide, cocamido-propyl-betaine, phosphate polyether ester, or a mixture thereof. The surfactant may be 5% to 50% of the composition.

In one aspect, the present invention is directed to a composition that contains 9.25 weight % of $C_{12}$-$C_{15}$ linear primary alcohol ethoxylate and 38.6 weight % of phosphoric acid. In another aspect, the present invention is directed to a composition that contains 9.25 weight % of $C_{12}$-$C_{15}$ linear primary alcohol ethoxylate, 9.64 weight % of phosphoric acid, and 8.87 weight % of hydrofluorosilicic acid. In yet another aspect, the present invention is directed to a composition that contains 9.25 weight % of $C_{12}$-$C_{15}$ linear primary alcohol ethoxylate, 28.93 weight % of phosphoric acid, and 3.00 weight % of hydrofluorosilicic acid. In yet another aspect, the composition contains 5.0 weight % of $C_{12}$-$C_{15}$ linear primary alcohol ethoxylate and 16.8 weight % of hydrofluorosilicic acid. The composition may be in a liquid form, a gel form, or a solid form.

Also provided herein, is a method of treating a stained area of a textile. The method may comprise (a) contacting the laundry stain removal composition with the textile; (b) laundering the textile of under conditions wherein the pH is less than or equal to 5.5 and the temperature is ≥80° F.; and, optionally, (c) rinsing the textile with water and/or (d) laundering the textile in the presence of chlorine, such as chlorine bleach. A chlorine-based bleaching agent may not be present in any of steps (a), (b), or (c). Step (d) may be performed in the presence of a detergent such as an alkaline detergent, a non-alkaline detergent, or a mixture thereof. The textile is stained with CHG. The CHG stain on the textile may be pre-spotted with the laundry stain removal composition.

Also provided herein is a kit for removing CHG from a textile. The kit may contain the composition described herein. The composition may contain an acid and a surfactant. For example, the composition may comprise 5.0 weight % of $C_{12}$-$C_{15}$ linear primary alcohol ethoxylate and 16.8 weight % of hydrofluorosilicic acid. The composition may be in a container. The kit may also have a second container that comprises a non-chlorine detergent or bleach. The kit may also contain usage instructions. The instructions may refer to the composition and the detergent and/or bleach and describe how to these reagents, such as how to perform and/or monitor the methods described herein.

DETAILED DESCRIPTION

Figure 1:
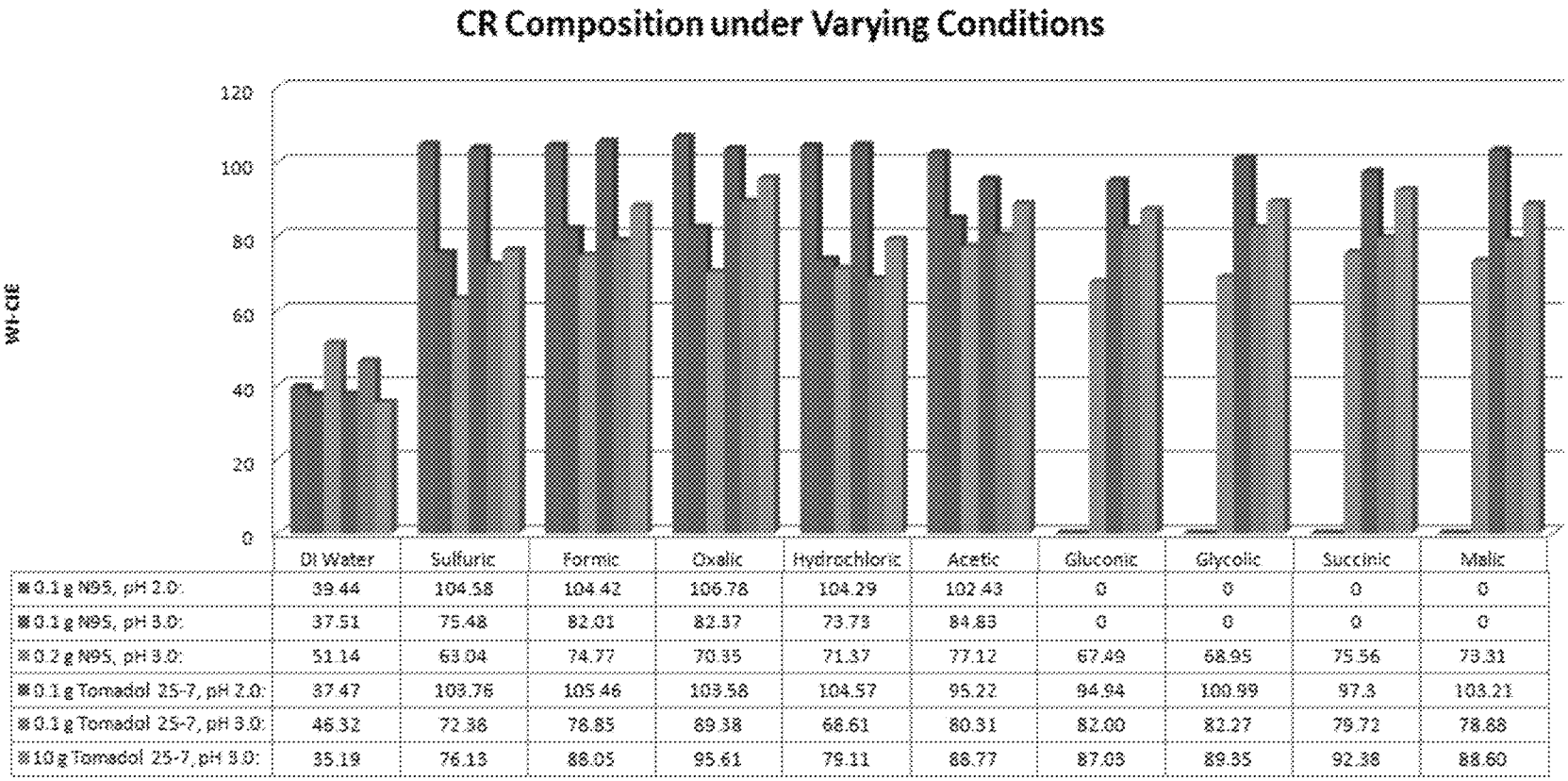
FIG. 1 shows a chart with the whiteness index values derived from CHG-stained textiles treated with different CHG removal compositions.
Figure 2:
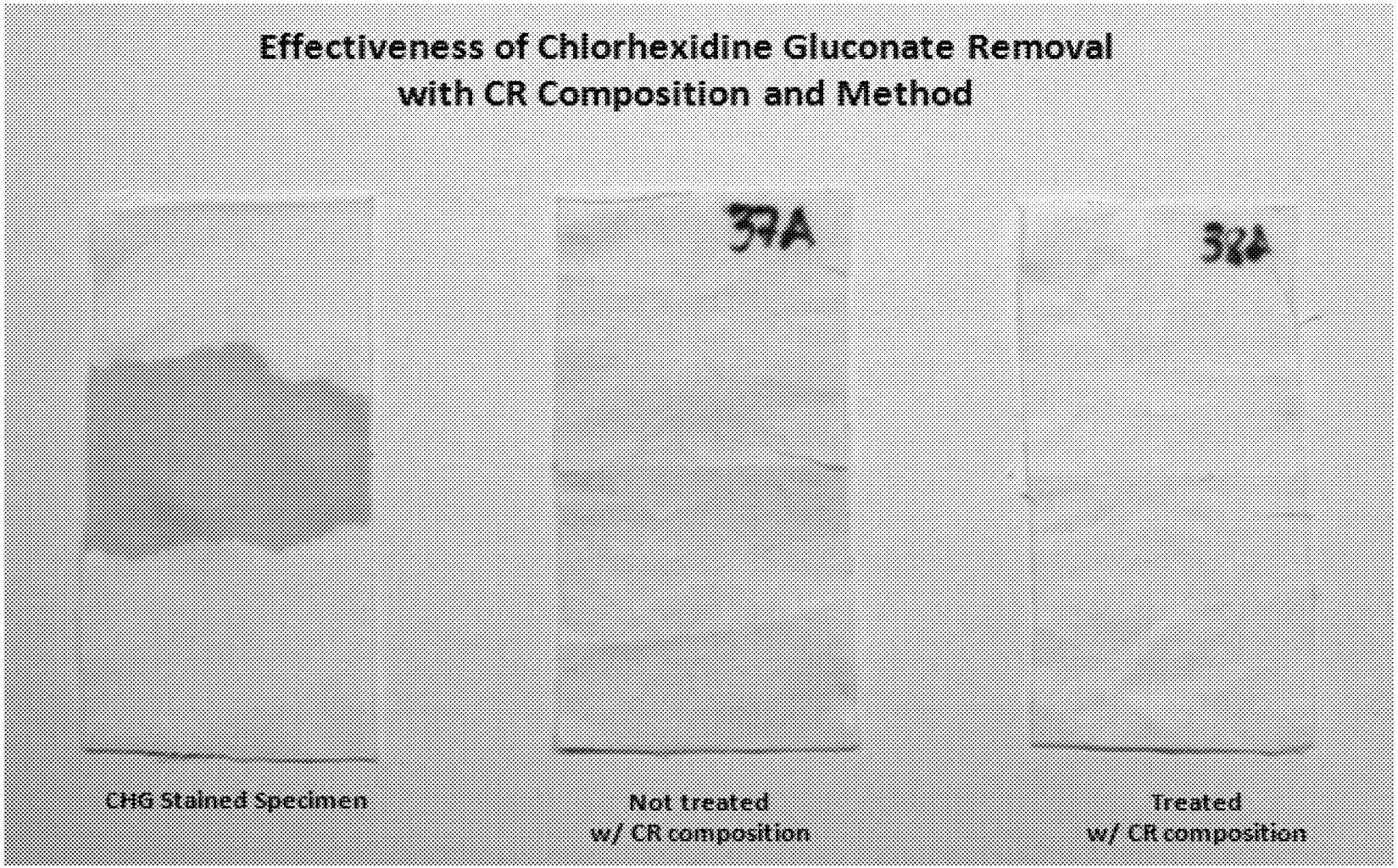
FIG. 2 shows three swatches of cotton/polyester fabric: a CHG-stained swatch (left), the CHG-stained swatch swatch after being laundered with traditional wash (center), and the CHG-stained swatch treated with the CHG removal composition prior to traditional wash (right).

The inventors have made the surprising discovery that CHG may be removed from a textile that has not been exposed to a chlorine based bleaching agent subsequent to exposure to CHG. This removal avoids the development of a permanent stain that is associated with traditional wash methods that utilize chlorine-based bleaching agents. Central to this discovery is an acid and surfactant combination composition, which is applied to the CHG-exposed textile. This application of the composition results in a pH value of 2.0 to 5.5 in the wash liquor that surrounds the textile. The acidic nature of the liquor reduces CHG binding to the textile, while the surfactant component aids in the removal of any bound CHG from the textile. Standard laundering methods may then be used and may include the use of a detergent, alkali, and/or chlorine based bleaches.

1. Definitions

The terminology used herein is for the purpose of describing particular embodiments only and is not intended to be limiting. As used in the specification and the appended claims, the singular forms "a," "and" and "the" include plural references unless the context clearly dictates otherwise.

a. Textile

"Textile" as used herein may any object, article or thing made from or containing at least in part some woven or non-woven fabric portion. Examples of such a fabric include, but are not limited to, clothing, clothes articles, gowns, jackets, coats, ponchos, overcoats, textiles, textile articles, upholstered items, such as cushions, purses, bags, wallets, carrying bags, luggage, satchels, shoes, boots, sneakers, shoe inserts, gloves, hats, and articles coating woven or non-woven portions such as rugs, floor mats, toilet seat covers, carpets, curtains, window shades, window covers, car and vehicle covers, tarpaulins, pet beds, pillows and soft articles, such as stuffed animals, children's toys, blankets, play rugs, mats, exercise mats, and the like. Also included are fabric materials consisting of natural and/or synthetic fibers in the form of hair, fur, fuzzy materials, velcro hook and loop fastening materials, and soft articles comprising natural and/or synthetic material constructs such as foam, sponge, microspun articles, laminates, and elastomeric items such as diving suites and related diving wear, overcoats, overshoes, protective vests and outerwear such as bullet-proof and sharp-object protective clothing including gloves and vests. The textile may be made of natural and/or artificial materials, such as cotton, polyester, nylon, rayon, wool, and silk.

b. Detergent "Detergent" as used herein may mean one or more laundry additives including detergents, surfactants, boosters, bleaching agents, sanitizers, stain removing products, and the like, as well as other additives now known or as yet unknown to one skilled in the art.

For the recitation of numeric ranges herein, each intervening number there between with the same degree of precision is explicitly contemplated. For example, for the range of "6-9" or "6 to 9," the numbers 7 and 8 are contemplated in addition to 6 and 9, and for the range "6.0-7.0" or "6.0 to 7.0," the number 6.0, 6.1, 6.2, 6.3, 6.4, 6.5, 6.6, 6.7, 6.8, 6.9, and 7.0 are explicitly contemplated. Furthermore, for example, for the range of between 6 and 9, the numbers 7 and 8 are contemplated in addition to 6 and 9, and for the range between 6.0 and 7.0, the number 6.0, 6.1, 6.2, 6.3, 6.4, 6.5, 6.6, 6.7, 6.8, 6.9, and 7.0 are explicitly contemplated.

2. CHG-removal ("CR") Composition

Provided herein is a composition ("CR composition") that is capable of removing CHG from a textile. The CR composition contains one or more acids and one or more surfactants, which are capable of adjusting the pH of the wash liquor that surrounds the textile to 1.5 to 6.0, 2.0 to 5.5, 2.5 to 3.5, or 2.0 to 3.0. The pH of the wash liquor that surrounds the textile may be less than or equal to 5.5, less than or equal to 4.5, or less than or equal to 3.5, for example. The CR composition may have a pH value of less than or equal to 2.0, less than or equal to 1.5, less than or equal to 1.0, or less than or equal to 0.5. The CR composition may be in the form of a gel, liquid, or solid. The CR composition may dissolve in water. The CR composition may be in the form of a liquid, paste, gel, bar, tablet, spray, foam, powder or granular form. A granular CR composition may also be in "compact" form, the liquid compositions can also be in a "concentrated" form. The "compact" form of the CR composition may be reflected by density and, in terms of composition, by the amount of inorganic filler salt. Inorganic filler salts are conventional ingredients of detergent compositions in powder form; in conventional detergent compositions, the filler salts are present in substantial amounts, typically 17-35% by weight of the total composition.

The liquid CR composition may be in a "concentrated form," whereby it contains a lower amount of water, so as to impart the requisite pH to the environment around the textile when the CR composition is in contact with the textile, particularly the CHG-stained portion of the textile. The water content of the concentrated CR composition may be less than or equal to 40%, more preferably less than or equal to 30%, most preferably less than or equal to 20% by weight of the detergent composition.

The CR composition may include a liquid carrier. In one embodiment, the liquid carrier comprises water, as water is a readily available, relatively inexpensive liquid carrier. In addition, water may facilitate the cleaning of water-soluble stains. However, other suitable liquid carriers may include propylene glycol, glycerin or other aforementioned glycol ethers or blends thereof.

In still another embodiment, the CR composition may include one or more enzymes that provide additional cleaning performance and/or fabric care benefits. Enzymes suitable for use in the CR composition of the present invention include proteases, cellulases, hemicellulases, peroxidases, glucoamylases, lipases, cutinases, pectinases, xylanases, reductases, oxidases, phenoloxidases, lipoxygenases, ligninases, pullulanases, tannases, pentosanases, malanases, glucanases, arabinosidases, and/or other now known or hereafter devised enzymes and/or mixtures thereof. The CR composition may also include a non-chlorine based bleaching agent.

a. Acid

The acid may be phosphoric acid, hydrofluorosilicic acid, citric acid, sulfuric acid, hydroxyacetic (glycolic) acid, benzoic acid, oxalic acid, acetic acid, formic acid, malic acid, succinic acid, gluconic acid, hydrochloric acid, boric acid, perchloric acid, nitric acid, nitrous acid, or a mixture thereof. The acid may be a mixture of phosphoric acid and citric acid. The acid may be a mixture of hydrofluorosilicic acid and citric acid. The acid may be a mixture of phosphoric acid and hydrofluorosilicic acid.

The acid may comprise 5.0 weight (wt) % to 80.0 wt % of the composition. The acid may comprise 10.0 wt % to 75.0 wt %, 15.0 wt % to 70.0 wt %, 20.0 wt % to 65.0 wt %, 25.0 wt % to 60.0 wt %, 30.0 wt % to 55.0 wt %, 35.0 wt % to 45.0 wt %, or 37.5 wt % to 42.5 wt % of the overall composition. The acid may comprise 2.00 to 30.00 wt % of the composition. The acid may comprise 15.0 wt %, 15.1 wt %, 15.2 wt %, 15.3 wt %, 15.4 wt %, 15.5 wt %, 15.6 wt %, 15.7 wt %, 15.8 wt %, 15.9 wt %, 16.0 wt %, 16.1 wt %, 16.2 wt %, 16.3 wt %, 16.4 wt %, 16.5 wt %, 16.6 wt %, 16.7 wt %, 16.8 wt %, 16.9 wt %, 17.0 wt %, 17.1 wt %, 17.2 wt %, 17.3 wt %, 17.4 wt %, 17.5 wt %, 17.6 wt %, 17.7 wt %, 17.8 wt %, 17.9 wt %, 18.0 wt %, 18.1 wt %, 18.2 wt %, 18.3 wt %, 18.4 wt %, 18.5 wt %, 18.6 wt %, 18.7 wt %, 18.8 wt %, 18.9 wt %, 19.0 wt %, 19.1 wt %, 19.2 wt %, 19.3 wt %, 19.4 wt %, 19.5 wt %, 19.6 wt %, 19.7 wt %, 19.8 wt %, 19.9 wt %, 20.0 wt %, 28.1 wt %, 28.2 wt %, 28.3 wt %, 28.4 wt %, 28.5 wt %, 28.6 wt %, 28.7 wt %, 28.8 wt %, 28.81 wt %, 28.82 wt %, 28.83 wt %, 28.84 wt %, 28.85 wt %, 28.86 wt %, 28.87 wt %, 28.88 wt %, 28.89 wt %, 28.90 wt %, 28.91 wt %, 28.92 wt %, 28.93 wt %, 28.94 wt %, 28.95 wt %, 28.96 wt %, 28.97 wt %, 28.98 wt %, 28.99 wt %, 29.00 wt %, for example.

b. Surfactant

The surfactant may be any surfactant, which may generally be classified as a nonionic, anionic, cationic, amphoteric or zwitterionic compound. The surfactant may be nonylphenol ethoxylate ("NPE") (having 6 to 15 EO units), linear alcohol ethoxylate ("LAE") ($C_{12}$-$C_{15}$ alcohol having 5 to 12 EO units), linear alcohol ethoxylate ($C_{12}$-$C_{13}$ alcohol having 3 to 12 EO units), or a mixture thereof. The surfactant may increase the solubility of the CHG, or suspends the CHG by forming lamellar micelles, or both.

Illustrative examples of the nonionic surfactants which may be used in this invention include fatty alcohol polyalkylene ethers resulting from condensation reactions, like fatty alcohol polyethylene glycol ethers and polyethylene/polypropylene (copolymer) glycol ethers. Such surfactants typically have an aliphatic portion comprising from about 8 to about 18 carbon atoms and about 2 to about 65 moles of alkoxylated portion per mole of aliphatic group. As to the alkoxylated portions, they are typically about 1:10 to about 10:1 ethylene oxide:propylene oxide when copolymers are employed. Other nonionic surfactants include ethylene oxide-propylene oxide block copolymers (weight average molecular weight of about 500 or more with ethylene oxide: propylene oxide portions being in a ratio of about 1:10 to about 10:1) and ($C_8$-$C_{18}$) fatty acid ($C_1$-$C_8$) alkanol amides like fatty acid ethanol amides.

Additional nonionic surfactants which may be used in the stain removal composition of this invention include N-alkylpyrrolidones, like N-octylpyrrolidone; polyalkylene oxide condensates of alkylphenols whereby the alkyl group has from about 5 to about 15 carbon atoms (straight or branched), the alkylene oxide preferably being ethylene oxide with from about 2 to about 65 moles of ethylene oxide per mole of alkyl phenol. The alkyl substituent is limited only to the extent that it does not interfere with the formation of the compound. Such a substituent is often derived from a $C_6$-$C_{14}$ alkane.

Still other examples of nonionic condensation products which may be used as the nonionic surfactants of this invention include the reaction product of $C_2$-$C_5$ diamines, like ethylene diamine, and excess $C_2$-$C_5$ alkylene alkylene oxide, like propylene oxide. Such products typically have a weight average molecular weight of about 500 to about 10,000, and they may be branched, linear, homopolymers, copolymers or terpolymers.

Nonionic tertiary phosphine oxides and long chain dialkyl sulfoxides may also be employed in the stain removal compositions of this invention, as well as nonionic surfactants generally classified as organosiloxanes. The organosiloxanes are often sold under the name Silwet®. Such surfactants typically have an average weight molecular weight of about 350 to about 15,000, are hydrogen or $C_1$-$C_4$ alkyl capped and are hydrolyzable or non-hydrolyzable. Preferred organosiloxanes include those sold under the name of Silwet L-77, L-7602, L-7604 and L-7605, all of which are polyalkylene oxide modified dialkyl polysiloxanes.

Illustrative examples of the anionic surfactants that may be employed in this invention include ($C_8$-$C_{16}$) alkylbenzene sulfonates, ($C_8$-$C_{18}$) alkane sulfonates, ($C_8$-$C_{18}$) α-olefin sulfonates, α-sulfo ($C_8$-$C_{16}$) fatty acid methyl esters, ($C_8$-$C_{16}$) fatty alcohol sulfates, mono- and di-alkyl sulfosuccinates with each alkyl independently being a ($C_8$-$C_{16}$) alkyl group, alkyl ether sulfates, ($C_8$-$C_{16}$) salts of carboxylic acids and isethionates having a fatty chain of about 8 to about 18 carbons and phosphate esters.

The cationic surfactants which may be used in this invention include those comprising amino or quarternary ammonium hydrophilic moieties that possess a positive charge in an aqueous solution. An illustrative list of the cationic surfactants that may be used in this invention includes cetyl trimethyl ammonium bromide, ditallow dimethyl ammonium methyl sulfate and the like, including any other commercially available salt of a primary, secondary or tertiary fatty amine. Other cationic surfactants include amine oxides like lauryl and stearyl amine oxide.

As to the amphoteric surfactants which may be used in this invention, such surfactants include alkyl betaines and those broadly described as derivatives of aliphatic quarternary ammonium, phosphonium and sulfonium compounds whereby the aliphatic radical can be straight or branched with one of the aliphatic substituents containing from about 8 to about 18 carbon atoms and one containing an anionic water solubilizing group such as a carboxy, sulfonate, sulfate, phosphate or phosphonate group.

The zwitterionic surfactants that may be used in this invention include those which may be broadly classified as derivatives of aliphatic quaternary ammonium, phosphonium and sulfonium compounds wherein the aliphatic radicals can be straight or branched with one of the aliphatic substituents containing from about 8 to about 18 carbons and one containing an anionic group such as a carboxy, sulfonate, sulfate, phosphate or phosphonate group.

The surfactant may comprise 3.0 wt % to 30.0 wt % of the composition. The surfactant may comprise, for example, 5.0 wt % to 20.0 wt %, 5.0 wt % to 25.0 wt %, 7.0 wt % to 20.0 wt %, 10.0 wt % to 20.0 wt %, 10.0 wt % to 25.0 wt %, 12.0 wt % to 18.0 wt %, 8.00 wt % to 60.00 wt % or 15.0 wt % to 25.0 wt % of the overall composition. The surfactant may comprise, for example, 4.0 wt %, 4.1 wt %, 4.2 wt %, 4.3 wt %, 4.4 wt %, 4.5 wt %, 4.6 wt %, 4.7 wt %, 4.8 wt %, 4.9 wt %, 5.0 wt %, 5.1 wt %, 5.2 wt %, 5.3 wt %, 5.4 wt %, 5.5 wt %, 5.6 wt %, 5.7 wt %, 5.8 wt %, 5.9 wt %, 6.0 wt %, 6.1 wt %, 6.2 wt %, 6.3 wt %, 6.4 wt %, 6.5 wt %, 6.6 wt %, 6.7 wt %, 6.8 wt %, 6.9 wt %, 7.0 wt %, 7.1 wt %, 7.2 wt %, 7.3 wt %, 7.4 wt %, 7.5 wt %, 7.6 wt %, 7.7 wt %, 7.8 wt %, 7.9 wt %, 8.0 wt %, 8.1 wt %, 8.2 wt %, 8.3 wt %, 8.4 wt %, 8.5 wt %, 8.6 wt %, 8.7 wt %, 8.8 wt %, 8.9 wt %, 9.0 wt %, 9.1 wt %, 9.2 wt %, 9.3 wt %, 9.4 wt %, 9.5 wt %, 9.6 wt %, 9.7 wt %, 9.8 wt %, 9.9 wt %, 10.0 wt %, 9.15 wt %, 9.16 wt %, 9.17 wt %, 9.18 wt %, 9.19 wt %, 9.20 wt %, 9.21 wt %, 9.23 wt %, 9.24 wt %, 9.25 wt %, 9.26 wt %, 9.27 wt %, of the composition.

3. Method of Removing CHG from a Textile

Provided herein is a method of removing CHG from a textile. The CR composition may be contacted with the textile to form a CR-textile combination that is and then laundered in a chlorine-free condition. The chlorine-free condition has a pH of less than or equal to 5.5 and a temperature of ≥80° F. (≥26.6° C.). After the CR-textile combination has been laundered in the chlorine-free condition, the CR-textile combination may (or may not) be rinsed to release the CR composition from the textile, thereby forming a rinsed textile, or the CR-textile may be laundered in the presence or absence of traditional laundry products, such as detergents, which may or may not contain chlorine or chlorine bleach. The CR-textile combination may be rinsed in a separate step or cycle. The rinsed textile may then be laundered in the presence or absence of chlorine or chlorine bleach.

a. CR Composition Contact with Textile

The CR composition may be contacted with the textile by any means to form the CR-textile combination. When applying the CR composition to the textile with the CHG targeted for removal, there is no limitation with respect to how the CR composition is applied as long as the CR composition contacts the CHG. For example, the CR composition may be sprayed or rubbed onto the textile. The CR composition may be applied via a rag, a brush, by prespotting, or by dipping the contaminated substrate into the stain removal composition, an aerosol applicator or a trigger spray bottle. The preferred way to apply the stain removal composition is, however, with a conventional trigger spray bottle.

The CR composition may be directly added to the wash liquor of a wash operation, such as a washer, into which the textile is added. The CR composition may be directly added to the wash liquor in the first step of a wash operation, such as a washer, into which the textile is added. Moreover, the amount of stain removal composition employed is typically enough to cover the contaminant targeted for removal.

b. Chlorine-free Laundering of the CR-textile Combination

The CR-textile combination may be laundered in essentially any washing, cleaning and/or fabric care method, including soaking methods, pre-treatment methods, methods with rinsing steps for which a separate rinse aid composition may be added, and post-treatment methods. The CR-textile combination may be laundered in a laundering solution, which may contain a detergent. The laundering solution may not contain chlorine, for example, chlorine bleach. The laundering solution may contain a non-chlorine bleaching agent.

The CR-textile may be contacted with a laundering solution in the usual manner. The method of laundering is preferably carried out at ≥26.6° C., ≥29.4° C., ≥32.2° C., ≥35° C., ≥37.7° C., ≥40.6° C., ≥43.3° C., ≥48.8° C., ≥54.4° C., ≥60° C., or ≥65.5° C. The wash liquor may have a pH of 1.5 to 6.0, 2.0 to 5.5, 2.5 to 3.5, or 2.0 to 3.0. The pH of the wash liquor is preferably less than or equal to 5.5. The pH of the wash liquor that surrounds the textile may be less than or equal to 5.5, less than or equal to 5.4, less than or equal to 5.3, less than or equal to 5.2, less than or equal to 5.1, less than or equal to 5.0, less than or equal to 4.9, less than or equal to 4.8, less than or equal to 4.7, less than or equal to 4.6, less than or equal to 4.5, or less than or equal to 3.5, for example. The CR-textile may be laundered for 2 minutes to 30 minutes, 5 minutes to 30 minutes, 10 minutes to 30 minutes, 15 minutes to 30 minutes, 20 minutes to 30 minutes, 25 minutes to 30 minutes, 5 minutes to 120 minutes, 10 minutes to 120 minutes, 20 minutes to 120 minutes, 30 minutes to 120 minutes, 40 minutes to 120 minutes, 50 minutes to 120 minutes, 60 minutes to 120 minutes, 75 minute to 120 minutes, or 100 minutes to 120 minutes or longer. After the CR-textile has been laundered, it may be rinsed to release any CR composition from the textile, thereby forming the rinsed textile. The mechanical action of the machine carrying out the laundering is described below.

(1) Non-chlorine Bleaching Agent

Preferred additional optional detergent ingredients that can be included in the laundering solution include conventional activated-, other enzymatic- and/or metallo catalyst-based bleach systems. One or more oxygenase(s) with a bleach system may provide improved cleaning when formulated as laundry composition.

The bleaching agent component for use herein can be any of the bleaching agents useful in the laundering solution, including oxygen bleaches as well as others known in the art. The bleaching agent suitable for the present invention can be an activated or non-activated bleaching agent.

Bleaching agents are such as hydrogen peroxide, PB 1, PB4 and percarbonate with a particle size of 400-800 microns. These bleaching agent components can include one or more oxygen bleaching agents and, depending upon the bleaching agent chosen, one or more bleach activators. When present oxygen bleaching compounds will typically be present at levels of from about 1% to about 25%.

The hydrogen peroxide releasing agents can be used in combination with bleach activators such as tetraacetylethylenediamine (TAED), nonanoyloxybenzene-sulfonate (NOBS, described in U.S. Pat. No. 4,412,934), 3,5,-trimethylhexanoloxybenzenesulfonate (ISONOBS, described in EP 120,591) or pentaacetylglucose (PAG) or Phenolsulfonate ester of N-nonanoyl-6-aminocaproic acid (NACA-OBS, described in WO94/28106), which are perhydrolyzed to form a peracid as the active bleaching species, leading to improved bleaching effect. Also suitable activators are acylated citrate esters such as disclosed in Copending European Patent Application No. 91870207.7.

One category of oxygen bleaching agent that can be used encompasses percarboxylic acid bleaching agents and salts thereof. Suitable examples of this class of agents include magnesium monoperoxyphthalate hexahydrate, 4-nonylamino-4-oxoperoxybutyric acid and diperoxydodecanedioic acid. Such bleaching agents are disclosed in U.S. Pat. No. 4,483,781, U.S. patent application Ser. No. 740,446, European Patent Application 0,133,354 and U.S. Pat. No. 4,412,934. Highly preferred bleaching agents also include 6-nonylamino-6-oxoperoxycaproic acid as described in U.S. Pat. No. 4,634,551.

Useful bleaching agents, including peroxyacids and bleaching systems comprising bleach activators and peroxygen bleaching compounds for use in detergent compositions according to the invention are described in our co-pending applications U.S. Ser. No. 08/136,626, PCT/US95/07823, WO95/27772, WO95/27773, WO95/27774 and WO95/27775.

The hydrogen peroxide may also be present by adding an enzymatic system (i.e. an enzyme and a substrate therefore) which is capable of generating hydrogen peroxide at the beginning or during the washing and/or rinsing process. Such enzymatic systems are disclosed in EP Patent Application 91202655.6 filed Oct. 9, 1991.

Peroxidase enzymes are used in combination with oxygen, hydrogen peroxide sources, e.g. percarbonate, perborate, persulfate, hydrogen peroxide, etc and a bleach enhancer. They are used for "solution bleaching", i.e. to prevent transfer of dyes or pigments removed from substrates during wash operations to other substrates in the wash solution. Peroxidase enzymes are known in the art, and include, for example, horseradish peroxidase, ligninase and haloperoxidase such as bromo-peroxidase. Peroxidase-containing detergent compositions are disclosed, for example, in PCT International Application WO 89/099813, WO89/09813 and in European Patent application EP No. 91202882.6, filed on Nov. 6, 1991 and EP No. 96870013.8, filed Feb. 20, 1996. Also suitable is the laccase enzyme.

Enhancers are generally comprised at a level of from 0.1% to 5% by weight of total composition. Preferred enhancers are substitued phenthiazine and phenoxazine 10-Phenothiazinepropionicacid (PPT), 10-ethylphenothiazine-4-carboxylic acid (EPC), 10-phenoxazinepropionic acid (POP) and 10-methylphenoxazine (described in WO 94/12621) and substitued syringates (C3-C5 substitued alkyl syringates) and phenols. Sodium percarbonate or perborate are preferred sources of hydrogen peroxide.

Said peroxidases are normally incorporated in the detergent composition at levels from 0.0001% to 2% of active enzyme by weight of the detergent composition.

c. Rinsing and/or Laundering of the CR Textile

After the CR-textile combination is laundered with a non-chlorine bleaching agent, the CR textile may be rinsed, thereby forming a rinsed textile, and/or laundered in essentially any washing, cleaning and/or fabric care method, including soaking methods, pre-treatment methods, methods with rinsing steps for which a separate rinse aid composition may be added, and post-treatment methods. Rinsing and/or laundering of the CR textile may release the CR composition from the textile. The CR textile or rinsed textile may be laundered in a laundering solution, which may contain a detergent. The laundering solution may contain chlorine, for example, chlorine bleach.

The CR textile or rinsed textile may be contacted with a laundering solution in the usual manner. A conventional laundry method as used herein may comprise laundering the CR textile or rinsed textile with an aqueous liquid having dissolved or dispensed therein an effective amount of the laundry detergent and/or fabric care composition. Laundering the CR textile or rinsed textile may be carried out at 5° C. to 95° C., especially 10° C. to 60° C. The pH of the laundering solution is preferably from 7 to 12.

d. Machine Laundering

Any of the above-described laundering processes may entail placing the textile into a high efficiency washing machine or a regular (non-high efficiency) washing machine and, optionally, also placing an effective amount of laundry detergent and/or fabric care into the machine. The washing machine may be a top-loader, a front-loader machine, a commercial/industrial/institutional front-loading or side-loading washer, such as a batch washer, for example. A high efficiency machine may be defined by the Soap and Detergent Association as any machine that uses about 33% to about 66% of the water, and as little as about 33% to about 50% of the energy, of a traditional, regular agitator washer. The washing machine may be a batch washer, a tunnel washer, a modular washer, or a sectional washer. Any of the washers may be automated. The batch washer may be an automated continuous batch tunnel washer. Any commercially available washer may be used. Typical washing systems may be manufactured by Pellerin Milonor Corporation or G.A. Braun, Inc., for example.

(1) Tunnel Washer

The tunnel washer may consist of a long metal tunnel, wherein a metal spiral ("Archimedes Screw" or "screw") runs through the center of the metal tunnel. The screw divides the tunnel into "pockets," also known as "compartments." The tunnel may contain between 2 and 25 pockets. The tunnel may contain between 5 and 20, between 8 and 20, between 10 and 18, between 12 and 16, or between 10 and 20 pockets. Textiles may be loaded into one end of the tunnel and water loaded into the other end and moves down the tunnel. Proper chemicals, such as detergent(s), bleach(es), etc., are added along the length of the tunnel. The textiles are forced in one direction and water is forced in the opposite direction allowing the textiles to be transported through cleaner water and fresher chemicals. The screw may rotate partially and may reverse to provide agitation for the textiles in each pocket. After an allotted amount of time has passed, the screw may make a complete rotation, whereby the textiles move forward into a next pocket. The textiles may be forced from one end of the tunnel to the other. Soiled textiles may continuously go into one end of the tunnel, while clean textiles move continuously out of the other end.

Each batch of textiles may, alternatively, be lifted from the water in one pocket, thereby draining the free water, and then placed into the next pocket. In the next pocket, the textiles may be exposed to cleaner water and/or fresh chemicals. This process may allow for each pocket to provide an independent bath, whereby the appropriate water and chemicals may be targeted to the proper baths, i.e. the water and chemicals do not transfer to other or subsequent baths. An exemplary system is the CBW® Batch Washer by Pellerin Milnor Corp.

4. Kit

Provided herein is a kit, which may be used for removing a CHG stain from a textile. The kit may comprise a CR composition and a detergent provided in two separate containers, for use on the textile. The two containers may be packaged together, for example, in a cardboard box. The kit may also include a set of usage instructions, which refer to the CR composition and the detergent. The instructions may describe how to perform and/or monitor the method described herein.

The present invention has multiple aspects, illustrated by the following non-limiting examples.

EXAMPLES

Example 1

Method for CHG Removal

The purpose of this method is to evaluate the effectiveness of acid/surfactant solutions on CHG stain removal and to establish the most effective removal composition and optimum treatment conditions (i.e. pH, temperature, time).

This test method closely follows AATCC Test Method 61-2008 Colorfastness to Laundering: Accelerated for the assessment of color changes and staining after laundering. Test swatches were stained with CHG, allowed to age, and then laundered with an acid/surfactant solution. Immersion of the swatches in a chlorine bleach bath was followed to verify thorough removal of the CHG stain. If the pink stained area turns brown, or the sample develops a light brown hue throughout, the wash solution is not effective. Swatches are examined for both the removal of pink stain and measured for the whiteness after chlorine exposure.

The equipment used in this test method included an Atlas Launder-ometer® AATCC Standard Instrument, which is a large vessel filled with water containing a stainless steel rotor that holds up to 5×16 oz. metal canisters on each of the four sides and rotates at a constant 40 rpm. A stainless steel heater maintains constant temperatures. Temperature and cycle times may be changed according to the required test specifications. Stainless steel ball bearings provide agitation within the canisters. An SDL Atlas G210 Color Chex 60 was also used as a light box having five light sources that include artificial daylight D65, horizon daylight (HOR), Illuminant "A", narrow-band fluorescent, and ultraviolet light. Artificial daylight which is useful for discerning changes in color was also used for visual assessment of test pieces. An X-Rite Spectrophotometer Color i5 was used for spectrophotometer measurements, which provide a numerical value for whiteness indices, blueness/yellowness, and lightness that may not be significantly perceptible to the naked eye allowing for a more accurate comparative analysis. Other pieces of equipment used during the test method include a Mettler Toledo G5002-S balance and a Thermo Electron Corporation Orion 410A+pH meter.

Stained swatches were prepared 24 to 48 hours prior to set-up and testing. See Sample Preparation Method below. The set up for the method begins with the selection and recording of parameters for each test are selected and recorded: Temperature (i.e.: 80, 100, 120, and 145° F.); Cycle time (i.e.: 2 or 10 minute); and Type and quantity of acid and surfactant (per 1000 g of deionized water) to be tested. The 4×4 inch swatches are labeled with the corresponding test number and letter; each swatch is then coupled with a 4×4 in. sample of terry towel and poly/cotton fabric. The Launder-ometer is turned on and run with the heat on until required temperature is attained. The metal canisters for each test swatch are then filled with X amount of ball bearings to provide mechanical action and agitation.

The sample(s) is prepared as follows: 4×4 inch swatches of 65% cotton/35% polyester fabric are cut and laid out. Each swatch is stained across the center with 1 cc of CHG. They are allowed to age 24 to 48 hours at room temperature prior to any testing. Depending on the test date, the samples may be put into the oven for accelerated aging. For next day testing, the samples should be allowed to dry at 40° C. for 12 to 16 hours. Stained swatches aged over 48 hours are not used. Test fabrics are not limited to cotton/polyester blends. Alternate fabric samples may be used. Fabric type, composition, and source should be recorded.

The test solutions are prepared as follows: the required amount of surfactant is weighed into each beaker, and 1000 g of deionized water added and then mixed. The pH of the solution is adjusted to the specified pH for that test, and the amount of acid used to reach that pH is recorded.

The experiment is conducted as follows (after attaining the appropriate temperature for the experiment): after the solutions are prepared, 250 mL of each solution is poured into each designated canister. The swatches are then put into the canisters, and the metal canisters capped. The canisters are placed into the steel rotor and secure in the Launder-ometer, and run for the designated cycle time. When the cycle has ended, the canisters are emptied, and the test swatches promptly rinsed (with cool tap water). The swatches are then examined for any residual pink stains and then cut in half. The left half of each of the samples should be dried. Record if pink stain is removed or not. (Part I of evaluation procedure). A 150 ppm chlorine bleach bath is then prepared and heated. Upon reaching a temperature of 145° F., the chlorine bleach is added and the right halves are immersed for 10 minutes. The swatches are then rinsed, dried, and compared to their unexposed halves. Spectrophotometer measurements of the right halves are taken and whiteness index readings compared to the whiteness readings of the unwashed standard control. (Part II of evaluation procedure).

The effectiveness of the acid//surfactant solution on CHG stain removal is based on both a visual assessment and on instrumental assessment. Visual assessment of the samples consists of observing for a residual pink or the development of a brown stain or hue. Instrumental assessment quantifies the whiteness indices of the test specimens subjected to the colorfastness acid/surfactant and chlorine wash tests.

AATCC Evaluation Procedure 9-2007 (Visual Assessment of Color Differences of Textiles) and AATCC Test Method 110:2005 (Whiteness of Textiles) are used as a basis for the following evaluation procedures.

a. Part I of Evaluation Procedure

Visual Assessment under Illuminant D65 (Artificial Daylight). The samples are observed under artificial daylight illuminant and checked for a remaining pink stain and brown stain.

1. The samples are examined and checked for any residual pink staining after the acid/surfactant wash test and prior to the chlorine bleach bath. It is recorded if any hint of pink color is present.

2. The left halves of the samples are dried. After the right halves of the test samples are immersed in the 150 ppm chlorine bath, rinsed and dried, any visibly significant differences in hue or the development of brown staining in comparison to the unexposed left half should be recorded. See below.

| Sample XXA | | Notes: |
|---|---|---|
| pH: | | |
| Surfactant | | g/L surfactant name |
| Acid | | g acid name |
| Pink Stain Removal prior to chlorine? | Y or N | |
| Brown Stain Appears after chlorine? | Y or N | |

b. Part II of Evaluation Procedure: Instrumental Assessment

In this part of the evaluation procedure, the whiteness of the test specimens after the chlorine bath is measured and compared to the whiteness of the original, unwashed fabric. Spectrophotometer measurements of each test specimen are taken to attain numeric values of the whiteness indices (only the right halves of the test samples are measured). Whiteness Index (WI-CIE) is a value for how white a textile appears based on the International Commission on Illumination. See *Technical Manual of the American Association of Textile Chemists and Colorists*, Volume 85, 2010.

1. A minimum of five spectrophotometer measurements of various areas of the fabric being used for testing should be taken. These readings should then be averaged into the standard reference specimen called "Avg. Standard" and saved. This may be done if a new type of fabric is being utilized for the wash tests.

2. Measurements of the right halves of the test specimens are then taken. Each right half should be folded in half to make specimen opaque.

3. The readings for each test specimen are labeled with the specimen test number and letter.

4. Measurements of the test specimen and the reference specimen may include other data such as lightness, chroma, hue, and change in energy, but only whiteness index values are used for the evaluation.

5. The data for each test specimen and the reference specimen is copied to an excel file.

6. The whiteness index values for the test samples are compared to the reference samples, and the changes in whiteness calculated.

Example 2

Acid Screen

Twelve acids have been tested for use as part of the CR composition: Hydrofluorosilicic, Phosphoric, Citric, Sulfuric, Formic, Oxalic, Hydrochloric, Acetic, Gluconic, Glycolic, Succinic, and Malic acids. Previously, hydrofluorosilicic, phosphoric, and citric acids were compared at a pH of 2.0 over a temperature range of 80° F. to 145° F. and at 2 minute and 10 minute cycle times. These tests verified phosphoric acid to be an effective acid at temperatures as low as 80° F. and at short 2 minute cycle times.

The acids that remained to be tested were run at 145° F. with a 10 minute cycle time under the following conditions (Table 1):

TABLE 1

| Test | Surfactant Used | % Surfactant | Target pH |
|---|---|---|---|
| 20 | Nonylphenol Ethoxylate w/6-15 EO units | 0.01% | 2.0 |
| 21 | Nonylphenol Ethoxylate w/6-15 EO units | 0.01% | 3.0 |
| 22 | Nonylphenol Ethoxylate w/6-15 EO units | 0.02% | 3.0 |
| 23 | LAE ($C_{12}$-$C_{15}$ w/5-12 EO units) | 0.01% | 2.0 |
| 24 | LAE ($C_{12}$-$C_{15}$ w/5-12 EO units) | 0.01% | 3.0 |
| 26 | LAE ($C_{12}$-$C_{15}$ w/5-12 EO units) | 1.00% | 3.0 |

It was established from these tests that CHG removal was dependent more on pH than the type of acid. Those samples subjected to the CR-composition solutions at pH 2.0 resulted in higher whiteness indices. Increasing the amount of surfactant from 0.1% to 1.0% did increase the whiteness by 5 to 6%. Based on whiteness index values of the stained samples after exposure to chlorine solutions and on visual assessment, it may be concluded that Oxalic and Succinic acids performed best at low and high pH. Those samples subjected to sulfuric and formic acids resulted with a slight brown hue, and those exposed to the hydrochloric, acetic, gluconic, glycolic, and malic acids were average producing samples that were off-white. FIG. 1 is a chart with the whiteness index values for each acid at varying conditions.

Final testing will be carried out to compare oxalic, succinic, citric, and phosphoric acids at lower temperature range and shorter cycle times. Based on these results, subsequent testing of the effect of the CR composition on swatches previously laundered on a hydrogen peroxide formula will be investigated to ensure that the solution is just as effective.

Phosphoric, Citric, Oxalic, and Succinic acids were reevaluated at a temperature of 145° F. and ten minute cycle times. The CR-composition solution was taken to a pH of approximately 3.0 but the samples were not significantly whitened. Therefore subsequent testing with a pH near 2.5 was carried out, but whiteness within 95% of the standard whiteness reading was not attained. In the below table, it can be seen that although low pHs do aid in the removal of CHG stains, the quantity of acid is also a factor. See Table 2.

TABLE 2

| Sample | pH | Acid | Acid quantity | Surfactant | Surfactant quantity | WI-CIE | Std WI-CIE | ΔWI-CIE |
|---|---|---|---|---|---|---|---|---|
| 28 B | 2.48 | Phosphoric | 0.610 g | LAE ($C_{12}$-$C_{15}$ w/5-12 EO units) | 0.20 g | 86.78 | 109.51 | 22.73 |
| 13 E | 2.57 | Phosphoric | 1.356 g | Nonylphenol Ethoxylate w/6-15 EO units | 0.07 g | 110.63 | 115.99 | 5.36 |
| 27 B | 2.95 | Phosphoric | 0.180 g | LAE ($C_{12}$-$C_{15}$ w/5-12 EO units) | 0.20 g | 77.74 | 109.51 | 31.77 |
| 28 C | 2.50 | Citric | 2.680 g | LAE ($C_{12}$-$C_{15}$ w/5-12 EO units) | 0.20 g | 90.85 | 109.51 | 18.66 |
| 13 F | 2.97 | Citric | 1.356 g | Nonylphenol Ethoxylate w/6-15 EO units | 0.07 g | 105.66 | 115.99 | 10.33 |
| 27 C | 3.00 | Citric | 0.350 g | LAE ($C_{12}$-$C_{15}$ w/5-12 EO units) | 0.20 g | 72.13 | 109.51 | 37.38 |
| 28 D | 2.48 | Oxalic | 0.480 g | LAE ($C_{12}$-$C_{15}$ w/5-12 EO units) | 0.20 g | 88.70 | 109.51 | 20.81 |
| 27 D | 2.93 | Oxalic | 0.200 g | LAE ($C_{12}$-$C_{15}$ w/5-12 EO units) | 0.20 g | 80.85 | 109.51 | 28.66 |
| 28 E | 2.60 | Succinic | 10.380 g | LAE ($C_{12}$-$C_{15}$ w/5-12 EO units) | 0.20 g | 88.11 | 109.51 | 21.40 |
| 27 E | 3.01 | Succinic | 1.390 g | LAE ($C_{12}$-$C_{15}$ w/5-12 EO units) | 0.20 g | 77.09 | 109.51 | 32.42 |

For example, the samples (28B and 13 E) were subjected to the phosphoric acid and surfactant solutions at a pH of 2.57 and 2.48. It is apparent that the sample washed with the solution containing more acid appeared whiter despite having a slightly higher pH reading.

From the above data, it can be seen that 10.380 g of succinic acid were required to bring the pH down to 2.60. This high amount of acid would make it unreasonable or rather unsuitable for use within the CR composition. While high amounts of oxalic acid were not needed for pH reduction, its performance and effectiveness in whitening the swatches to the extent that phosphoric acid or citric acid did was not considerable. Samples from previous tests were included in the table for comparative purposes. It is noticeable that surfactant nonylphenol ethoxylate with between 6 and 15 EO units was more effective, but taking into consideration that nonylphenol ethoxylates will eventually be eliminated from products, it makes more sense to use linear alcohol ethyoxylates within the CR composition. Presently, best results have been attained with 1.356 g/L of 75% Phosphoric acid and 0.2 g/L of nonylphenol ethoxylate with between 6 and 15 EO unites or LAE ($C_{12}$-$C_{15}$ with between 5 and 12 EO units).

Example 3

Acid Combination Testing

The following combinations of acids were prepared and used to bring the pH of the surfactant and water solution to approximately 2.5. The solutions were made with 0.2 g of LAE ($C_{12}$-$C_{15}$ with between 5 and 12 EO units) into 1000 g deionized water, and the samples were run at 145° F. (62.7° C.) for ten minute cycles. Results are shown in Table 3.

TABLE 3

| Sample | Mixture # | 3:1 Ratio | pH | Acid Quantity *per 1000 g deionized water | WI-CIE | ΔWI-CIE |
|---|---|---|---|---|---|---|
| 30A | None | No acid | 5.21 | n/a | 34.67 | 74.84 |
| 31A | Control | Only H3PO4 | 2.49 | 0.50 g | 94.94 | 14.57 |
| 30B | 1 | H3PO4:HFS | 2.50 | 1.00 g | 96.17 | 13.34 |
| 30C | 2 | H3PO4:Citric | 2.49 | 1.11 g | 97.06 | 12.45 |
| 31B | 7 | H3PO4:Sulfuric | 2.50 | 0.50 g | 91.36 | 18.15 |
| 30D | 3 | HFS:H3PO4 | 2.50 | 1.33 g | 96.44 | 13.07 |
| 30E | 4 | HFS:Citric | 2.50 | 1.75 g | 94.59 | 14.92 |
| 31D | 9 | HFS:Sulfuric | 2.50 | 1.11 g | 92.24 | 17.27 |
| 30F | 5 | Citric:H3PO4 | 2.50 | 2.34 g | 98.35 | 11.16 |
| 30G | 6 | Citric:HFS | 2.51 | 4.52 g | 97.48 | 12.03 |
| 31C | 8 | Citric:Sulfuric | 2.51 | 3.04 g | 94.89 | 14.62 |
| 31E | 10 | Sulfuric:H3PO4 | 2.50 | 1.06 g | 93.16 | 16.35 |
| 31F | 11 | Sulfuric:Citric | 2.50 | 3.28 g | 96.41 | 13.10 |
| 31G | 12 | Sulfuric:HFS | 2.49 | 2.27 g | 95.46 | 14.05 |

Based on the results shown in Table 3, phosphoric acid and citric acid combinations yielded the best results with respect to whiteness producing samples, with indices 2 to 3 points higher than the control. See Test 30 and Test 31. Previous tests, conducted at a pH of 2.5 and using just one acid (either phosphoric acid or citric acid) generated whiteness indices below 90. The above-described acid combinations in a CR composition are more effective on the removal of CHG stains than compared to a single acid in the CR composition.

Example 4

Surfactant Testing

The following surfactants were evaluated using the methods set forth in Example 1 with the corresponding testing conditions. See Table 4.

TABLE 4

| Surfactant | Type | pH | Acid Quantity ($H_3PO_4$) | WI-CIE | ΔWI-CIE |
|---|---|---|---|---|---|
| LAE ($C_{12}$-$C_{15}$ w/5-12 EO units) | nonionic | 2.50 | 0.98 g | 92.13 | 17.38 |
| Dodecyl benzene sulfonic acid | anionic | 2.49 | 0.99 g | 29.29 | 80.22 |
| Methyl-oxirane polymer w/oxirane | nonionic | 2.49 | 0.86 g | 88.47 | 21.04 |
| Alcohols, C12-C15, ethoxylated propoxylated | nonionic | 2.48 | 0.83 g | 88.65 | 20.86 |
| Sodium Xylene Sulfonate | anionic | 2.50 | 0.96 g | 89.39 | 20.12 |
| Sodium 2-ethylhexyl sulfate | nonionic | 2.50 | 0.96 g | 84.83 | 24.68 |
| Nonylphenol Ethoxylate 4 mol | nonionic | 2.51 | 0.98 g | 87.08 | 22.43 |
| D-Glucopyranose, oligomeric, C10-16-alkyl glycosides | nonionic | 2.49 | 1.04 g | 88.18 | 21.33 |
| Cocodiethanolamide | an/non | 2.50 | 0.98 g | 94.23 | 15.28 |
| Cocamido propyl betaine | amphoteric | 2.48 | 0.96 g | 95.32 | 14.19 |
| Phosphate polyether ester | anionic | 2.50 | 1.03 g | 93.86 | 15.65 |
| Sodium linear alkylbenzene sulfonate | amphoteric | 2.50 | 0.77 g | 55.21 | 54.3 |
| Isopropylamine branched dodecylbenzene sulfonate | anionic | 2.50 | 0.83 g | 53.39 | 56.12 |
| Sodium alkyl naphthalene sulfonate | anionic | 2.50 | 0.85 g | 83.28 | 26.23 |

Amphoteric and anionic surfactants: cocdiethanolamide, cocamido-propyl-betaine, and phosphate polyether ester provided whiteness index readings within 14 to 15 points of the standard whiteness index of 109.51 and were comparable with those of the LAE ($C_{12}$-$C_{15}$ with between 5 and 12 EO units). The integration of other classes of surfactants into the CR-Composition is possible and functional. Dodecyl benzene sulfonic acid was not effective; the sample washed with dodecyl benzene sulfonic acid and phosphoric acid appeared yellow in hue.

Based on the surfactant evaluations in Table 4 and acid mixture (See Table 3) results, the best performing surfactants were coupled with the best acid mixtures: Acid mixture #5 (Citric: H3PO4) and mixture #6 (Citric: HFS) from Table 3. Table 5 lists the combinations and results:

TABLE 5

| Test 34 (Surfactant + 2 Acid Mixture) | | | | | | |
|---|---|---|---|---|---|---|
| Surfactant | Type | Acid Mixture | pH | Acid Quantity | WI-CIE | ΔWI-CIE |
| LAE ($C_{12}$-$C_{15}$ w/5-12 EO units) | nonionic | H3PO4 | 2.48 | 1.17 g | 98.67 | 10.84 |
| Tallow Dihydroxyethyl Glycinate | anionic | Citric:H3PO4 | 2.51 | 3.08 g | 101.58 | 7.93 |
| Cocodiethanolamide | an/non | Citric:H3PO4 | 2.51 | 3.62 g | 98.57 | 10.94 |
| Cocodiethanolamide | an/non | Citric:HFS | 2.51 | 6.87 g | 99.88 | 9.63 |
| Cocamido propyl betaine | amphoteric | Citric:H3PO4 | 2.50 | 4.26 g | 94.1 | 15.41 |
| Cocamido propyl betaine | amphoteric | Citric:HFS | 2.51 | 6.26 g | 97.96 | 11.55 |
| Phosphate polyether ester | anionic | Citric:H3PO4 | 2.51 | 4.71 g | 95.36 | 14.15 |
| Phosphate polyether ester | anionic | Citric:HFS | 2.51 | 6.54 g | 99.36 | 10.15 |

A surfactant from previous tests, tallow dihydroxyethyl glycinate, was included in Test 34 for further evaluation. Exceptional results yielding whiteness readings within 10 points of the standard whiteness of 109.51 were exhibited by those samples subjected to the combinations highlighted above.

Supplementary evaluations of the effectiveness of two-component surfactant mixtures were subsequently completed. Tallow dihydroxyethyl glycinate, cocodiethanolamide, and phosphate polyether ester were each coupled with LAE ($C_{12}$-$C_{15}$ having 5 to 12 EO units) and combined with a 3-acid mixture; also included in the following tests were the surfactants dodecyl benzene sulfonic acid and LAE ($C_{12}$-$C_{13}$ having 3 to 12 EO units). Mixture A was comprised of 3 parts phosphoric acid, 1 part HFS, and 1 part Citric. Mixture B consisted of 3 parts HFS acid, 1 part phosphoric acid and 1 part citric acid.

The combinations and resulting whiteness index readings are provided in Table 6.

TABLE 6

| Surfactant Mixtures + 3 Acid Mixture A | | | | | |
|---|---|---|---|---|---|
| 2-Surfactant Mixture | Acid Mixture A | pH | Acid Quantity | WI-CIE | ΔWI-CIE |
| 3 LAE ($C_{12}$-$C_{15}$ w/5-12 EO units)(Control) | 3 H3PO4:1 HFS:1 Citric | 2.51 | 2.04 | 89.62 | 19.89 |
| 3 LAE ($C_{12}$-$C_{15}$ w/5-12 EO units):1 Tallow Dihydroxyethyl Glycinate | 3 H3PO4:1 HFS:1 Citric | 2.52 | 2.19 | 87.39 | 22.12 |
| 3 LAE ($C_{12}$-$C_{15}$ w/5-12 EO units):1 Cocodiethanolamide | 3 H3PO4:1 HFS:1 Citric | 2.50 | 2.09 | 87.36 | 22.15 |
| 3:1 Phosphate polyether ester | 3 H3PO4:1 HFS:1 Citric | 2.51 | 2.05 | 88.16 | 21.35 |
| 3 LAE ($C_{12}$-$C_{15}$ w/5-12 EO units):1 LAE ($C_{12}$-$C_{13}$ w/3-12 EO units) | 3 H3PO4:1 HFS:1 Citric | 2.52 | 1.96 | 83.70 | 25.81 |
| 3 LAE ($C_{12}$-$C_{15}$ w/5-12 EO units):1 Dodecyl Benzene Sulfonate | 3 H3PO4:1 HFS:1 Citric | 2.51 | 2.04 | 78.58 | 30.93 |
| 3 LAE ($C_{12}$-$C_{15}$ w/5-12 EO units):1 Tallow Dihydroxyethyl Glycinate | 3 H3PO4:1 HFS:1 Citric | 2.51 | 2.04 | 89.62 | 19.89 |

TABLE 6-continued

| Surfactant Mixtures + 3 Acid Mixture B | | | | | |
|---|---|---|---|---|---|
| 2-Surfactant Mixture | Acid Mixture B | pH | Acid Quantity | WI-CIE | ΔWI-CIE |
| LAE ($C_{12}$-$C_{15}$ w/5-12 EO units) (CONTROL) | 3 HFS:1 H3PO4:1 Citric | 2.50 | 2.77 | 87.44 | 22.07 |
| 3 LAE ($C_{12}$-$C_{15}$ w/5-12 EO units):1 Tallow Dihydroxyethyl Glycinate | 3 HFS:1 H3PO4:1 Citric | 2.52 | 2.72 | 91.29 | 18.22 |
| 3 LAE ($C_{12}$-$C_{15}$ w/5-12 EO units):1 Cocodiethanolamide | 3 HFS:1 H3PO4:1 Citric | 2.51 | 3.03 | 91.37 | 18.14 |
| 3 LAE ($C_{12}$-$C_{15}$ w/5-12 EO units):1 Phosphate polyether ester | 3 HFS:1 H3PO4:1 Citric | 2.50 | 3.11 | 89.30 | 20.21 |
| 3 LAE ($C_{12}$-$C_{15}$ w/5-12 EO units):1 LAE ($C_{12}$-$C_{13}$ w/3-12 EO units) | 3 HFS:1 H3PO4:1 Citric | 2.51 | 2.91 | 87.93 | 21.58 |
| 3 LAE ($C_{12}$-$C_{15}$ w/5-12 EO units):1 Dodecyl Benzene Sulfonate | 3 HFS:1 H3PO4:1 Citric | 2.51 | 2.46 | 76.51 | 33.00 |

The LAE ($C_{12}$-$C_{15}$ having 5 to 12 EO units) in conjunction with Mixture A performed better than the other combinations, including a combination with Mixture B, on Test 35 having the sample with the higher whiteness index reading.

LAE ($C_{12}$-$C_{15}$ having 5 to 12 EO units) and straight phosphoric acid continue to be effective in CHG removal yielding consistent whiteness index readings. The performance of the dodecyl benzene sulfonate was not significantly improved with the addition of LAE ($C_{12}$-$C_{15}$ having 5 to 12 EO units). The two-component surfactant mixtures did not improve CHG removal when used in conjunction with the thee-acid mixtures. More information on the surfactants tested throughout the present disclosure, including trade names, and chemical name/type, are provided in the following Table 7.

TABLE 7

| Trade Name | Surfactant Type | Chemical Type/Name |
|---|---|---|
| Surfonic N-95, NPE 9 | nonionic | alkyl phenol ethoxylate, nonylphenol ethoxylate 9.5 mol |
| Surfonic N-60, NPE 6 | nonionic | alkyl phenol ethoxylate, nonylphenol ethoxylate 6 mol |
| Tomadol 23-5 | nonionic | C12-C13 linear primary alcohol ethoxylate |
| Tomadol 25-7 | nonionic | C12-C15 linear primary alcohol ethoxylate |
| Rhodia Mackam TM | amphoteric | Tallow Dihydroxyethyl Glycinate, Amines, tallow alkyl, ethoxylated, carboxylated |
| Rhodia Mackam BW-139 | amphoteric | Octyl Betaine, Octanaminium, N-(Carboxymethyl)-N, N-Dimethyl-, inner salt |
| Mackam 2CYSF | amphoteric | disodium capryloamphodipropionate, imidazolines and derivatives thereof |
| Rhodafac BG 510 | anionic | phosphate ester, polyoxyethylene isodecyl ether phosphate |
| DDBSA | anionic | dodecyl benzene sulfonic acid |
| Pluronic 25R2 | nonionic | block copolymers of ethylene and propylene oxides, methyl-oxirane polymer w/oxirane |
| Plurafac RA-30 | nonionic | oxyethylated straight chain alcohol, Alcohol, C12-C15 branched and linear, ethoxylated propoxylated |
| SXS 40% | anionic | Sodium Xylene Sulfonate |
| Kraftex OA | nonionic | alcohol sulfate/sodium salt, sodium 2-ethylhexyl sulfate |
| Surfonic N-40 | nonionic | nonylphenol ethoxylate, 4 mol |
| Glucapon 600 UP | nonionic | D-Glucopyranose, oligomeric, C10-16-alkyl glycosides |
| Mackamide CD | an/non | cocodiethanolamide, cocoamide DEA |
| Rewoteric AM B-14 U | amphoteric | betaine derivative, Cocamido Propyl Betaine |
| Triton H-55 | anionic | phosphate polyther ester |
| Ufaryl 85 | anionic | sodium linear alkylbenzene sulfonate |
| Ninate 411 | anionic | isopropylamine branched dodecylbenzene sulfonate, |
| Petro 22 | anionic | sodium alkyl naphthalene sulfonate |

Example 5

CR Composition Test

To confirm the efficacy of a test formula wherein the CR composition comprises 5.0 weight % of $C_{12}$-$C_{15}$ linear primary alcohol ethoxylate and 16.8 weight % of hydrofluorosilicic acid; a trial was initiated at a laundry facility processing approximately 15 million pounds of textiles per year. This particular facility was selected due to the high incidence of CHG-stained textiles received from customers of the laundry (hospitals, acute care facilities and related healthcare-related businesses). The washing equipment for the trial was a 12-module continuous batch washer. The aforementioned formula product was connected to the automated product dispensing system.

Upon conversion to the product and revised wash process at the laundry, wash test pieces were laundered with the normal textile loads to assess the effectiveness of the product. The wash test pieces were approximately 16"×16" swatches of 100% cotton sheeting fabric, to which 3"×3" test swatches were affixed. The test swatches were white, 65/35 cotton/polyester sheeting fabric which had been pre-stained with a popular liquid antiseptic containing 4% w/v chlorhexidene gluconate approximately seven days prior to their laundering during the field trial. The test pieces were introduced to the wash process via the regular soiled linen and accompanied the load of textiles as they were processed. When the textiles exited the wash process, the test pieces were retrieved and analyzed in the field. Since the test swatches were white and a permanently set CHG stain due to chlorine is brown, the effectiveness of the product and process could be quickly judged visually, comparing the processed swatches to new, unstained swatches. Any presence of light brown staining on the test swatches was deemed unacceptable. Wash test pieces were introduced to the washing process prior to the use of the current product and wash process; these wash test pieces displayed dark brown staining which was indicative of a CHG-stained textile.

During initial setup of the field trial, wash test pieces were introduced into the washing equipment accompanying loads of bath towels, bed sheets, bath blankets, patient gowns, incontinent pads and various other classifications of textiles. The CR composition was injected into the first washing module and the pH of the wash liquor was maintained above 3.0 and below or equal to 5.5 in modules 1 and 2. The wash test pieces were in contact with the CR composition in the first two modules. The wash test pieces were then contacted with detergent and chlorine bleach in module 4. After laundering and retrieval, the wash test pieces were analyzed and found to be free of any brown stains. The absence of CHG staining was deemed acceptable and the trial was allowed to continue. For a period of two months, bi-weekly visits were made to the laundry to monitor the field trial. The monitoring consisted of the use of wash test pieces to confirm the continued efficacy of the product and wash process; chemical titrations of the washing process; monitoring use of wash chemicals; and analysis of stained linen that was pulled from circulation by the laundry. The wash test pieces continued to be free of brown CHG stains, the chemical concentrations of the wash solutions was within specifications and the stained linen pulled from circulation did not show evidence of textiles permanently stained with CHG. The field trial progressed for an additional three months with monthly monitoring and wash test pieces continued to be free of any brown staining. The field trial was deemed successful.

We claim:

1. A laundry stain removal composition for removing CHG from a textile, comprising an acid and a surfactant, wherein the composition is capable of preventing permanent stains derived from contact between CHG and chlorine bleach on the textile, and wherein the composition comprises (a) 9.25 weight % of $C_{12}$-$C_{15}$ linear primary alcohol ethoxylate and 38.6 weight % of phosphoric acid;

(b) 9.25 weight % of $C_{12}$-$C_{15}$ linear primary alcohol ethoxylate, 9.64 weight % of phosphoric acid, and 8.87 weight % of hydrofluorosilicic acid; or (c) 9.25 weight % of $C_{12}$-$C_{15}$ linear primary alcohol ethoxylate, 28.93 weight % of phosphoric acid, and 3.00 weight % of hydrofluorosilicic acid.

2. The composition of claim 1, wherein the composition has a pH of less than or equal to 2.0.

3. The composition of claim 1, wherein the composition comprises 9.25 weight % of $C_{12}$-$C_{15}$ linear primary alcohol ethoxylate and 38.6 weight % of phosphoric acid.

4. The composition of claim 1, wherein the composition comprises 9.25 weight % of $C_{12}$-$C_{15}$ linear primary alcohol ethoxylate, 9.64 weight % of phosphoric acid, and 8.87 weight % of hydrofluorosilicic acid.

5. The composition of claim 1, wherein the composition comprises 9.25 weight % of $C_{12}$-$C_{15}$ linear primary alcohol ethoxylate, 28.93 weight % of phosphoric acid, and 3.00 weight % of hydrofluorosilicic acid.

6. The composition of claim 1, wherein the composition is in a form selected from the group consisting of a liquid, a gel, and a solid.

7. A method of treating a stained area of a textile comprising (a) contacting the composition of claim 1 with the textile;

(b) laundering the textile under conditions wherein the pH is less than or equal to 5.5 and the temperature is ≥80°F; and optionally, (c) rinsing the textile with water; and/or (d) laundering the textile in the presence of a chlorine bleach, wherein a chlorine-based bleaching agent is not present in any of steps (a), (b), or (c).

8. The method of claim 7, wherein the textile is stained with CHG.

9. The method of claim 7 wherein step (a) is performed by pre-spotting the textile with the composition.

10. The method of claim 7, wherein step (d) is performed in the presence of a detergent selected from the group consisting of an alkaline detergent, a non-alkaline detergent, and a mixture thereof.

11. The method of claim 7, wherein step (b) is performed under conditions wherein the pH is less than or equal to 3.5.

12. A kit for removing CHG from a textile, the kit comprising the composition of claim 1 in a first container.

13. The kit of claim 12, further comprising a non-chlorine detergent or bleach in a second container.

14. The kit of claim 13, further comprising usage instructions.

* * * * *